United States Patent [19]

Tirez

[11] Patent Number: 4,930,433

[45] Date of Patent: Jun. 5, 1990

[54] ARRANGEMENT FOR JOINTING TWO SURFBOARDS AS A WHOLE

[76] Inventor: Peter Tirez, Opwijksestraat 164, 9370 Lebbeke, Belgium

[21] Appl. No.: 132,164

[22] Filed: Dec. 11, 1987

[30] Foreign Application Priority Data

Dec. 12, 1986 [BE] Belgium ..... PV 0/217520

[51] Int. Cl.[5] ..... B63B 1/00

[52] U.S. Cl. ..... 114/61; 114/39.2; 114/354

[58] Field of Search ..... 114/39.1, 39.2, 61, 114/353, 354; 441/72, 73

[56] References Cited

U.S. PATENT DOCUMENTS 4,401,047 8/1983 Auras ..... 114/61

FOREIGN PATENT DOCUMENTS 2503658 10/1982 France ..... 114/39.2

84/00134 1/1984 PCT Int'l Appl. ..... 114/39.2

*Primary Examiner*—Joseph F. Peters, Jr.
*Assistant Examiner*—Jesus D. Sotelo
*Attorney, Agent, or Firm*—Cushman, Darby & Cushman

[57] ABSTRACT

The present invention relates to an arrangement for jointing two surfboards as a whole formed by a rectangular frame (4) consisting of two small cross-girders and two small longitudinal girders (5) and (6) having the following component parts:

(a) two sets of two arms (7), (8), (9) and (10) hingedly mounted in the plane of the frame;

(b) a hinged tripod (15) at one end of the rectangular frame; and (c) a hinged sailholder (21) at the other end of the same frame (4), all this in such a way that the whole of the component parts in the folded-up state falls within the dimensions of the frame (4).

9 Claims, 3 Drawing Sheets

ARRANGEMENT FOR JOINTING TWO SURFBOARDS AS A WHOLE

This invention relates to an arrangement for jointing two surfboards as a whole.

It is an object of the invention to provide an arrangement which on the one hand joints two surfboards and, on the other hand keeps folded the parts constituting said arrangement in a minimum volume, so that the transport thereof becomes possible in any kind of circumstances.

For that purpose, the arrangement according to the invention is formed by a rectangular frame consisting of two small cross-girders and two longitudinal girders having the following component parts:

(a) two sets of two arms rotatable in the plane of said frame and hingedly mounted therein, which arms are provided at, and near their ends with means whereby they can be joined to the surfboards;

(b) a hinged tripod at one end of the abovesaid rectangular frame, and (c) a hinged sailholder at the other end of the frame, all this in such a way that the whole of said component parts in the folded-up state falls within the dimensions of the abovesaid frame.

Still according to the invention each of the said arms shows a hinge joint on the frame lying on the side of the frame that is the most remote from the surfboard to which said arm is joined.

Still in order to achieve the same object, the abovesaid hinged tripod consists of the following component parts: a substantially triangular component part fixed transverselly to a small cross-girder of the abovesaid frame, said part comprising at the top a mastholder, and with the intermediary of a telescopic rod is joined to a rotatable support being hingedly fixed with each of its ends to the small longitudinal girders of the rectangular frame.

Further details and advantages of the invention will appear from the following description of an arrangement according to the present invention for jointing two surfboards as a whole. The present description is exclusively given as an example and does not limit the invention. The numbers refer to the accompanying drawings wherein.

Figure 1:
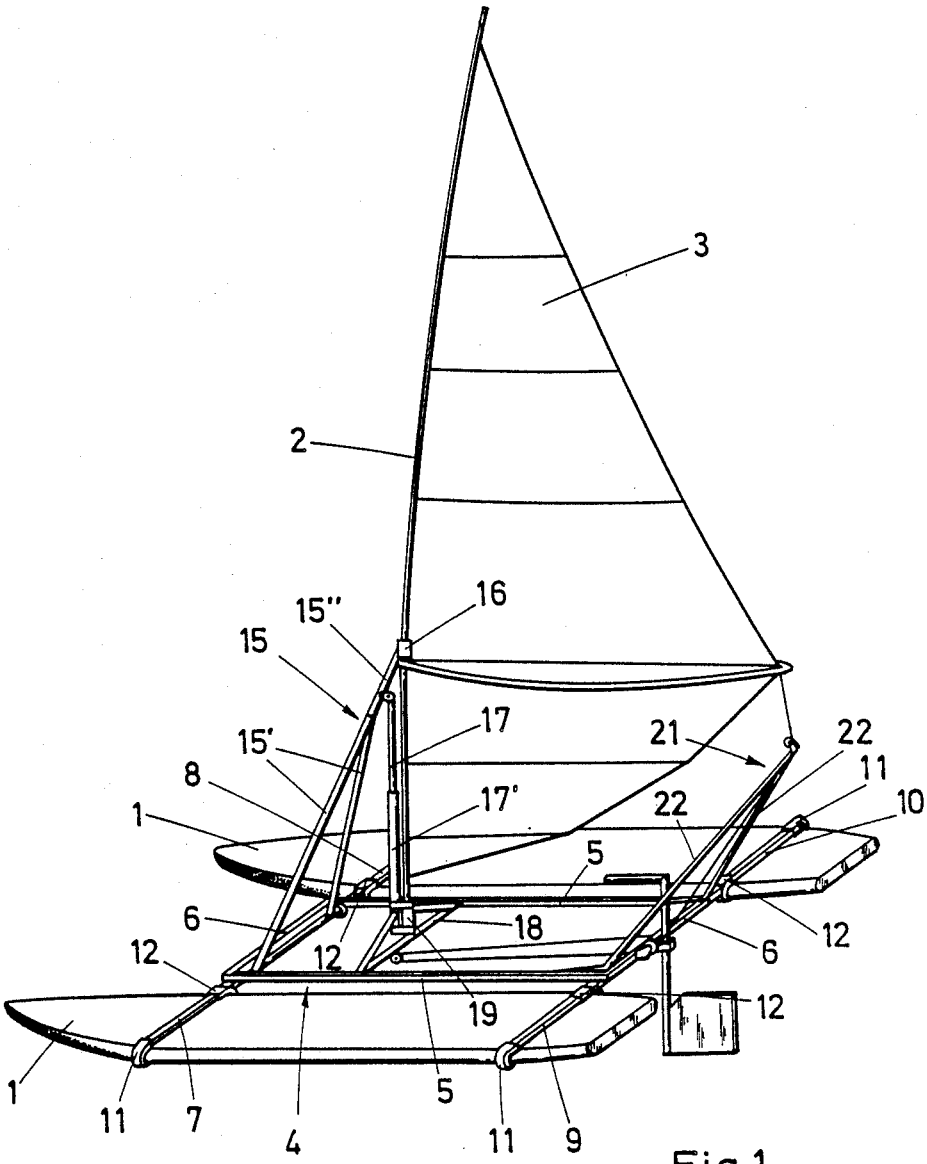
FIG. 1 is a perspective representation of the arrangement according to the invention.

The arrangement represented in these figures in intended for jointing two surfboards (1), so that after mounting the mast (2) and its sail (3) and applying the necessary seats, that are not represented in the figures, however, one or two persons can sit down.

The arrangement allowing such a mounting mainly consists of a frame (4) formed by two small longitudinal girders (5) and two small cross-girders (6). The section of these girders is arbitrary but of course is chosen depending on the necessary presence on this frame of hinge joints. The material of which the frame and the corresponding component parts are made is obviously a light metal or plastic.

For jointing surfboards (1) two sets of two arms each (7) and (8) at the one hand (in front), and (9) and (10) at the other hand (behind) are used. The extremities of the arms (7, 8, 9, 10) comprise hook-shaped grippers (11) that are fixed and covered with rubber or some synthetic elastomer. To the arms (7, 8, 9, 10) slidable, similar hook-shaped grippers (12) are applied as well, so that the distance between two grippers on one and the same arm can be adapted to the width of the surfboards.

Each of the arms (7–10), that can be considered as rotatable arms, has on the frame (4) a hinge joint on the longitudinal girder (5) that is the most remote from the surfboard to which the concerned arm is joined. Since the rotatable arms (7, 8, 9, 10) find themselves underneath the frame (4) and hinge in a plane parallel to the plane of said frame (4), a sturdy connection forms between said frame (4) and both surfboards (1). For that purpose, in addition a small plate (13) is provided underneath each of the rotatable arms (7–10), which plate is underneath in the operational position and hence extends as far as under the rotary arm cooperating with the concerned rotatable arm. Also two locking pins (14) are provided for keeping locked both rotatable arms of one set, i.e. (7, 8) at the one hand, and (9, 10) at the other hand, in the operational position with respect to the the frame.

With respect to the frame the mast (2) is maintained in its vertical position or nearly vertical position by means of a tripod, that is indicated in FIG. 1 with the general reference number (15). This tripod (15) consists of a triangular component part (15') hinged longitudinally with respect to the front cross-girder (6), which part at its top comprises a mast holder (16) and through a telescoping rod (17–17') is joined to a rotatable support (18) which with each of its ends is hingedly fixed to the small longitudinal girders (5) of the rectangular frame (4). The bottom part of the mast (2) rests in a bush (19) making part of, and being welded to the bottom end of the component part (17') of the telescoping rod (17–17').

Figure 6:
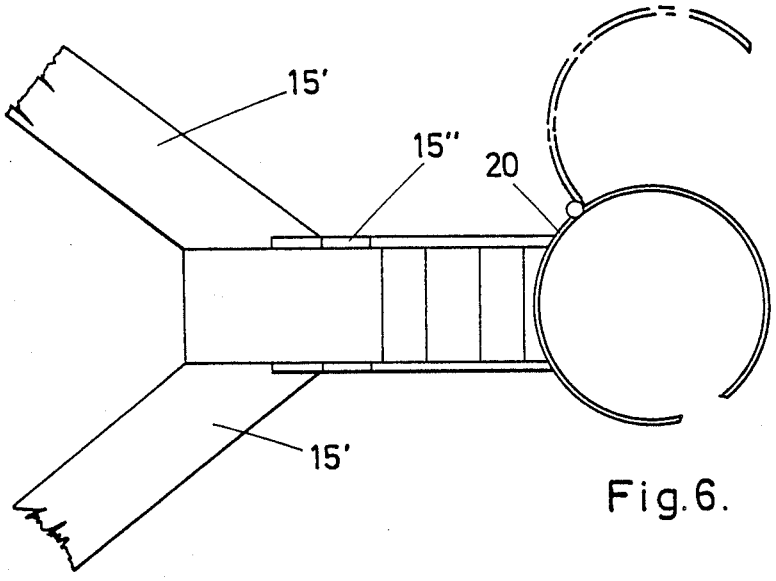
FIG. 6 represents, also at a larger scale, a top view of the closing bow of the mast holder.

The mast holder (16) making part of the upper part (15'') of the tripod (15') mainly consists of a lockable bow (20), which at the inside is preferably covered with TEFLON in order to prevent the mast from wearing at the place of said bow. Locking the bow (20) can take place by using a belt or similar aids. By means of a pin joint too, the movable part of the lockable bow can be locked with respect to the mast holder itself. In FIG. 6 the rotatable part of said lockable bow (20) is made clear in dotted line.

Behind the frame (4) there is the sail holder which is formed by the triangular component part (21). This triangular component part hinges underneath at the frame (4). Each of the legs (22) of said triangular component part (21) is bent underneath at an obtuse angle. The part (23) visible in the FIGS. 4 and 5 forms the end of a leg (22). The whole hinges in (24) with respect to the small longitudinal girders (5). A locking rod (25) can be slided forward and backward through the small bows (26) that are welded to the plate (27), which in its turn is welded to the part (23). One extremity of the rod (25) can be slided under the U-section (28) at the rear part of the frame (4).

Figure 4:
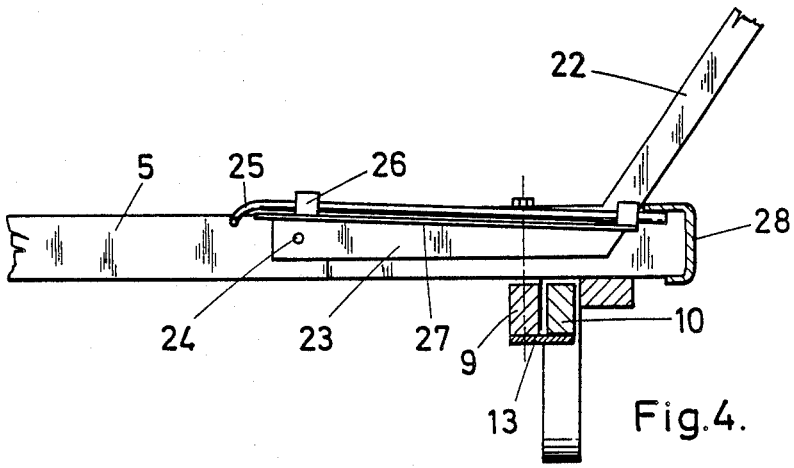
FIGS. 4 and 5 represent at a still larger scale and in two different positions, a detail of the arrangement according to the invention.
Figure 5:
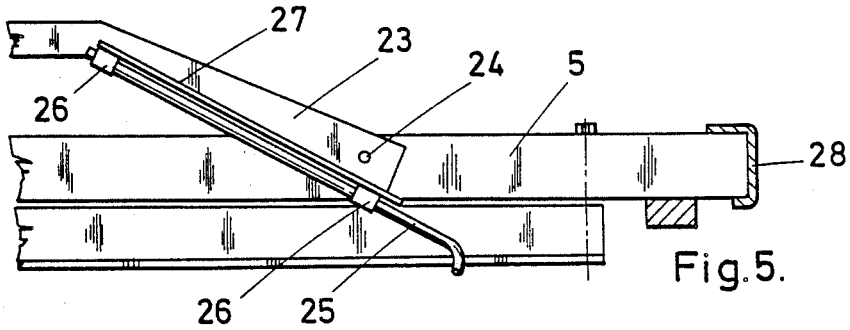

So, FIG. 4 relates to the locking position of the sail holder (21) and FIG. 5 to the unlocked position of the same component part.

Figure 2:
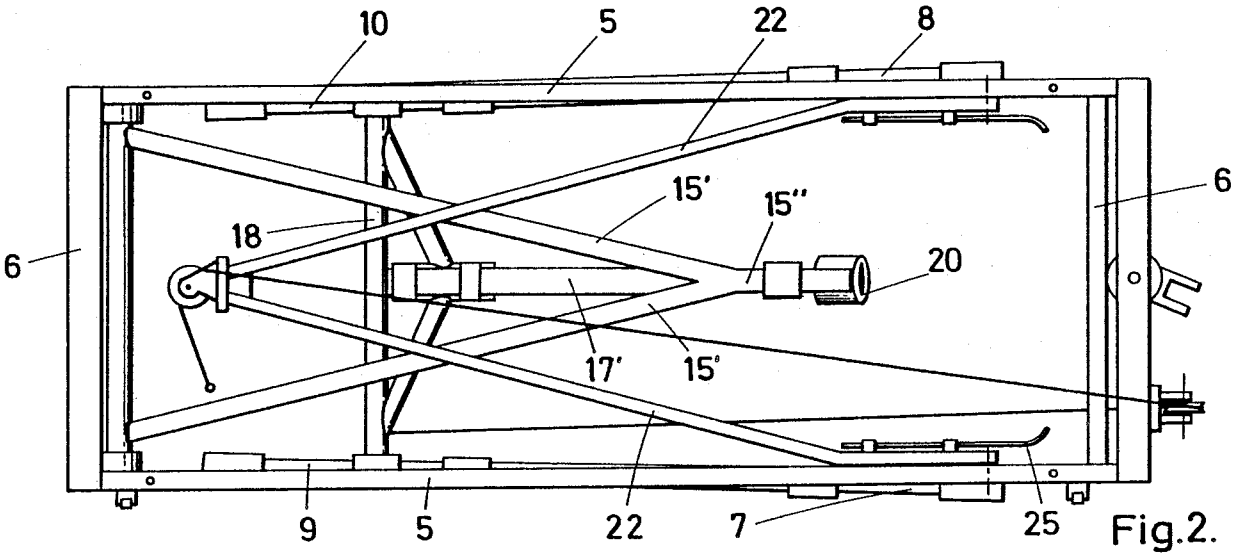
FIG. 2 is an enlarged-scale top view of the arrangement according to the invention in the folded state.
Figure 3:
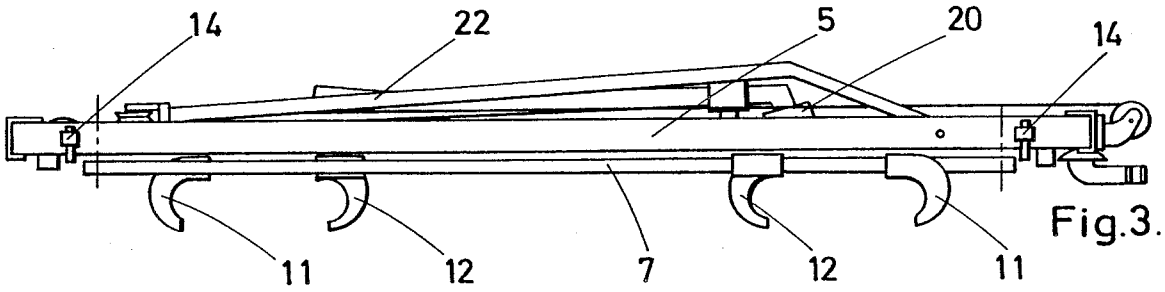
FIG. 3 is a side view of the arrangement according to the invention also in its folded stand.

In their folded-up position the parts of the arrangement fall within the frame (4), as clearly appears from FIG. 2, whereas the height of the whole, also considered in its folded-up state, may be called insignificant (FIG. 3). The ropes and small pulleys that are necessary for steering the boat generated by jointing two surfboards are not described in detail as they are not essential to the invention.

It will be remarked that it is clear that the cross-girders (6) of the frame (4) could be designed flexible, which also implies that the above-described component parts such as the tripod (15), the rotatable support (18) and the sailholder (21) could be designed flexible as well, although this has not been described in detail.

Further it is clear that the invention is not limited to the above-described embodiment and that many modifications could be made without departing from the scope of the patent application.

I claim:

1. Arrangement for jointing two surfboards as a whole including a rectangular frame (4) consisting of two small cross-girders and two small longitudinal girders (5) and (6) having the following component parts:

(a) two sets of two arms (7), (8), (9) and (10) hingedly mounted in the plane of said frame, which arms are provided at, and near their ends with means by which they can be joined to the surfboards;

(b) a hinged tripod (15) at one end of the abovesaid rectangular frame, and (c) a hinged sailholder (21) at the other end of the same frame (4), all this in such a way that the whole of said component parts in a folded-up state falls within the dimensions of the abovesaid frame (4).

2. Arrangement according to claim 1, wherein each of the said arms has a hinge joint on the frame lying on the side of the frame that is the most remote from the surfboard to which said arm is joined.

3. Arrangement according to claim 1, wherein both arms (7–8) and (9–10) of one set are hinged in the same plane.

4. Arrangement according to claim 1, wherein the means for joining a surfboard (1) to the end of a hinged arm (7–10) consist of hook-shaped grippers (11, 12) of which one gripper (12) is mounted at the side of the frame and is slidably supported on said arm.

5. Arrangement according to claim 1, wherein in every set of two hinged arms (7–10) every arm is provided with a small plate (13) extending in a plane parallel to the plane of said frame (4), which plate in the operational position slides under the other arm of the same set.

6. Arrangement according to claim 1, wherein on said frame a locking pin (14) is provided for every set of two hinged arms for maintaining both hinged arms (7–8) or (9–10) locked in the operational position.

7. Arrangement according to claim 1, wherein the said tripod (15) consists of the following component parts: a substantially triangular component part (15′) transverselly fixed to a small cross-girder of said frame, which part at its top comprises a mast holder (16) and through a telescoping rod (17–17′) is joined to a rotatable support (18) which with each of its ends is hingedly fixed to the small longitudinal girders (5) of the rectangular frame (4).

8. Arrangement according to claim 1, wherein the said hinged sailholder (21) is formed by a triangular component part having two legs (22) that are hinged at the frame and that near their hinge joint (24) are bent at an obtuse angle, and that a locking mechanism is provided for maintaining said hinged legs (22) in the operational position.

9. Arrangement for jointing two surfboards as a whole including a rectangular frame (4) consisting of two small cross-girders and two small longitudinal girders (5) and (6) having the following component parts:

(a) two sets of two arms (7), (8), (9) and (10) hingedly mounted in the plane of said frame, which arms are provided at, and near their ends with means by which they can be joined to the surfboard;

(b) a hinged tripod (15) at one end of the above said rectangular frame; and (c) a hinged sailholder (21) at the other end of the same frame (4), all this in such a way that the whole of said component parts in a folded-up state falls within the dimensions of the above said frame (4), wherein in every set of two hinged arms (7–10) these arms underneath the frame (4) are hinged at the latter.

* * * * *